US005123857A

United States Patent [19]

Lee Chao

[11] Patent Number: 5,123,857

[45] Date of Patent: Jun. 23, 1992

[54] ELECTRICAL CONNECTOR EMBEDDED WITH METAL LATCHES

[76] Inventor: Kuei L. Lee Chao, c/o Hung Hsing Patent Service Center, P.O. Box 55-1670, Taipei (10477), Taiwan

[21] Appl. No.: 792,686

[22] Filed: Nov. 15, 1991

[51] Int. Cl.[5] ..... H01R 13/62

[52] U.S. Cl. ..... 439/326

[58] Field of Search ..... 439/296, 326-328, 439/629-637

[56] References Cited

U.S. PATENT DOCUMENTS 4,986,765 1/1991 Korsunsky et al. ..... 439/326
4,995,825 2/1991 Korsunsky et al. ..... 439/326
5,002,498 3/1991 Takahashi ..... 439/326
5,004,429 4/1991 Yagi et al. ..... 439/326

*Primary Examiner*—Joseph H. McGlynn

[57] ABSTRACT

An electrical connector includes at least a pair of metal latches embedded in two opposite end portions of the connector, each latch having a pair of snapping leg members engageably locked in a recess portion recessed in each end portion of the connector and two latches insertably fixed on two opposite end portion of the connector for clamping a daughter printed circuit board on the connector so that the daughter board will be electrically connected with a mother printed circuit board secured under the connector.

7 Claims, 2 Drawing Sheets

ELECTRICAL CONNECTOR EMBEDDED WITH METAL LATCHES

BACKGROUND OF THE INVENTION

Some recent developments of electrical connectors for use in connecting a daughter printed circuit board with a mother printed circuit board are aimed to provide metal latches insertable in a connector base of each connector for clamping the daughter board, from which a damaged metal latch can be replaced with a new one, rather than discarding a complete set of electrical connector for saving cost.

Korsunsky et al. disclosed an electronic module socket with resilient latch in their U.S. Pat. No. 4,995,825. However, each metal latch 100 should be made to have a U-shaped engaging structure to be insertable in a pocket 40 formed with the housing 30, thereby possibly causing a production complexity of the connector.

It is therefore expected to disclose an electrical connector embedded with metal latches with simpler structure.

SUMMARY OF THE INVENTION

The object of the present invention is to provide an electrical connector including at least a pair of metal latches embedded in two opposite end portions of the connector, each latch having a pair of snapping leg members engageably locked in a recess portion recessed in each end portion of the connector and two latches insertably fixed on two opposite end portions of the connector for clamping a daughter printed circuit board on the connector so that the daughter board will be electrically connected with a mother printed circuit board secured under the connector.

DETAILED DESCRIPTION

Figure 1:
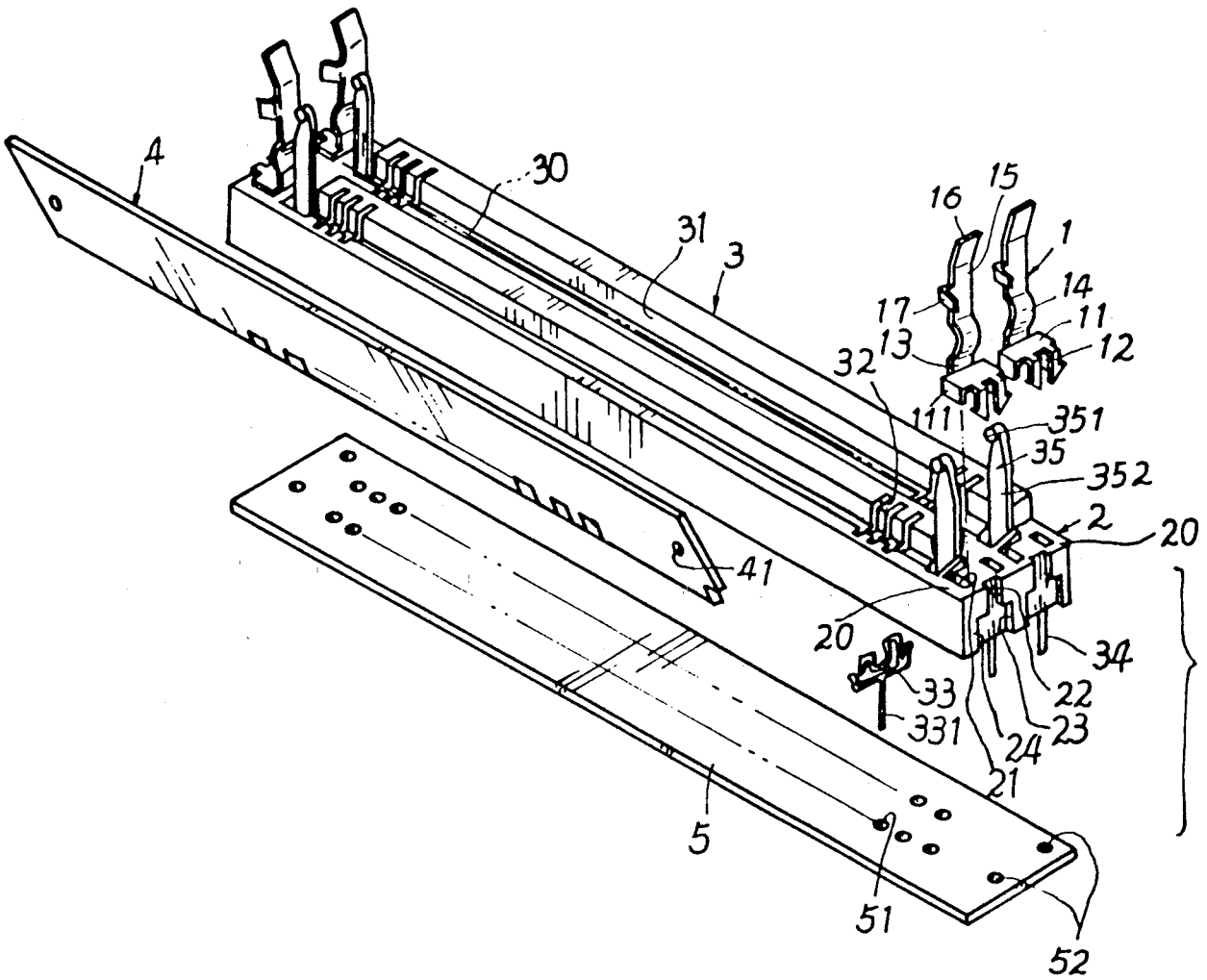
FIG. 1 is a perspective view of the present invention.
Figure 2:
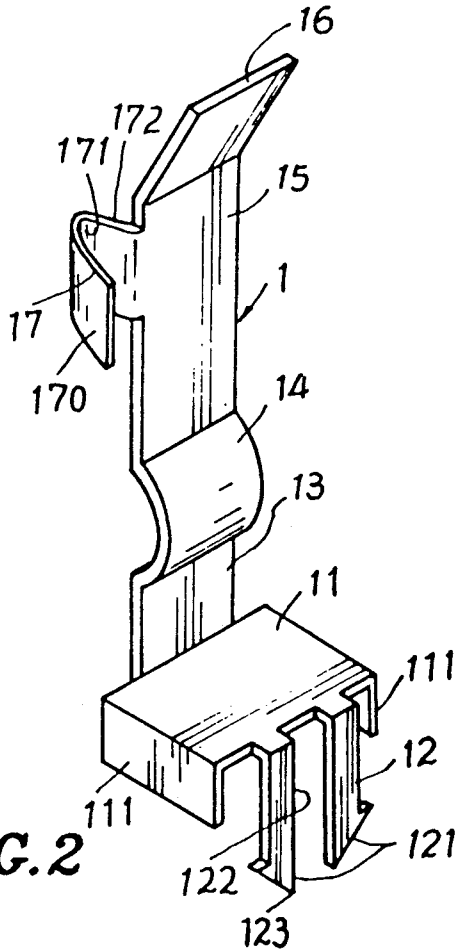
FIG. 2 is an illustration of a metal latch in accordance with the present invention.
Figure 3:
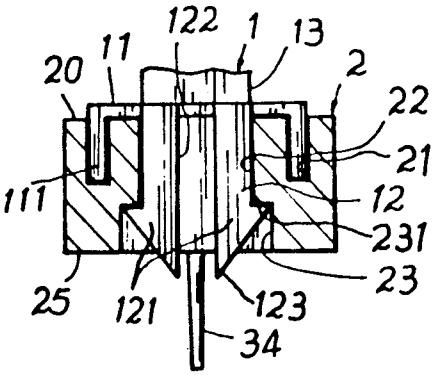
FIG. 3 is a partial sectional drawing when embedding the latch on a connector of the present invention.

As shown in FIGS. 1-3, the present invention comprises: an electrical connector 3 having a pair of metal latches 1 embedded in two latch holding bases 2 respectively formed on two opposite end portions of the connector 3 for electrically connecting a daughter printed circuit board 4 inserted in the connector 3 with a mother printed circuit board 5 connected under the electrical connector 3.

The electrical connector 3 includes: a longitudinal socket 31 longitudinally formed in the connector 3, a plurality of slots 32 transversely formed in the connector 3 each slot 32 generally perpendicular to the longitudinal socket 31 for embedding a spring contact element 33 having a supporting leg member 331 protruding downwardly from the connector 3 to be inserted into a leg hole 51 formed in the mother board 5, two peg members 34 protruding downwardly from two opposite bottom end portions of the connector 3 to be engageable with two peg holes 52 formed on two opposite end portions of the mother board 5, and two stop members 35 formed on two opposite end portions of the connector each stop member 35 generally parallel to the longitudinal socket 31 having an alignment protrusion 351 formed on a top portion of each stop member.

Each alignment protrusion 351 of the stop member 35 is engageable with an opening 41 formed on each side portion of the daughter board 4 when the daughter board 4 is inserted in the socket 31 of the connector 3.

Each latch holding base 2 formed on each end portion of the connector 3 includes: a horizontal surface portion 20 formed on an upper portion of the base 2, a pair of blade holes 21 slotted in the horizontal surface portion 20, an upper recess 22 recessed in an upper portion of a vertical surface portion 24 which is formed on an outer side portion of the connector 3 perpendicular to the horizontal surface portion 20, a lower recess 23 having a width larger than a width of the upper recess 22 and recessed in a lower portion of the vertical surface portion 24 communicating with and enlarged downwardly from the upper recess 22, and a bottom surface 25 formed on a bottom of the base 2 coplanar to a bottom surface of the connector 3, and two enlarged shoulder portions 231 diverging downwardly from the upper recess 23 and defined between the upper recess 22 and the lower recess 23.

Each metal latch 1 includes: a base plate 11 generally formed with a horizontal plate engageable with the latch holding base 2 formed on the connector 3, a pair of snapping leg members 12 protruding downwardly from an outer edge portion of the base plate 11 to be continuously engaged with the upper recess 22 and the lower recess 23 of the latch holding base 2, a vertical latch member 13 protruding upwardly from the base plate 11 to be perpendicular to the longitudinal socket 31 of the connector 3, an arcuate spring portion 14 concaved outwardly in a middle portion of the vertical latch member 13 normally restoring the vertical latch member 13 vertically, a depression plate portion 16 formed on an uppermost portion of the vertical latch member 13 protruding outwardly upwardly from the vertical latch member 13, and a latching wedge portion 17 formed on an upper portion of the vertical latch member 13 below the depression plate portion 16 tapered rearwardly and inwardly for slidably guiding a daughter board 4 to be resiliently clamped by the two latches 1 and stopped by the two stop members 35 respectively formed on two opposite end portions of the connector 3.

The latching wedge portion 17 has an acute angle 171 defined between a front wedge surface 170 and a rear vertical surface 172. The rear vertical surface 172 is generally perpendicular to an upper vertical surface portion 15 formed on an upper portion of the vertical latch member 13 for engageably retaining a daughter board clamped between the two latches 1.

The base plate 11 includes two embedding blade members 111 respectively protruding downwardly from a front and a rear edge portion of the base plate 11 to be engageable with the two blade holes 21 formed in the latch holding base 2.

The two snapping leg members 12 define a bifurcated aperture 122 between the two leg members 12 for a collapsible depression of the two members 12 for passing the upper recess 22 and for resiliently expandibly engaging a pair of hook portions 121 formed on two lower portions of the two leg members 12 to be lockably engageable with two enlarged shoulder portions 231 defined between the upper recess 22 and the lower recess 23.

Each hook portion 121 of each the snapping leg member 12 has a tip portion 123 formed on a lowermost portion of the leg member 12 to projectively protrude a bottom surface 25 of the base 2 and the connector 3.

Each metal latch 1 of the present invention is mounted on each latch holding base 2 by engaging the base plate 11 on the horizontal surface portion 20 of the base 2. The two blade members 111 of the latch 1 are depressibly inserted in the two blade holes 21 recessed in the base 2 and the two snapping leg members 12 are downwardly embedded into the upper recess 22 until the two hook portions 121 of the two leg members 12 engaging the enlarged shoulder portions 231 between the upper recess 22 and the lower recess 23. The two hook portions 121 are first depressibly "shrinked" in the narrower upper recess 22 and are then expanded to be snapped into the enlarged shoulder portions 231 for stably locking the latch 1 on the base 2 of the connector 1.

For maintenance purpose, two tips 123 projectively protruding beyond the base bottom 25 may be depressed inwardly to disengage from the enlarged shoulder portion 231 so that the latch 1 can be upwardly withdrawn for replacing a new one.

When mounting the daughter board 4 onto the connector 3, the daughter board 4 may be first inclinedly inserted into the lower longitudinal socket 31 of the connector 3 to be clamped by the plurality of spring contact elements 33 embedded in the connector 3 and the daughter board 4 is slidably guided by the two wedge portions 17 of the two latches 1 to be stably retained within the two latches 1 and the two stop members 35. Therefore, the daughter board is firmly connected on the connector 3 and the conducting area 42 formed on the lower portion of the daughter board 4 is electrically connected with the plural contact elements 33 and finally connected with the mother board 5 secured under the connector 3 for finishing the electrical connection between the two boards 4, 5.

The present invention is superior to a conventional electrical connector even provided with metal latches with the following advantages:

1. Just by simply depressing the latch 1 on the base 2 of the connector 3, the latch 1 can be fixed on the connector 3 quickly and conveniently.

2. A depression portion 16 is provided on an uppermost portion of each latch 1, which is easily depressed for resiliently ejecting a daughter board clamped by the spring contact elements 33 fixed in the connector 3 for enhancing a maintenance job for repairing or replacing the board 4 from the connector 3.

3. Both latch 1 and the connector 3 are simply constructed by eliminating any complex elements such as a "pocket" having side walls formed on the connector so as to greatly reduce the production and installation cost of the connector.

The sockets 31 of the connector 3 may be made plural for inserting a plurality of daughter board 4 therein. On two opposite sides of each socket 31, a pair of metal latches 1 of the present invention are provided.

Even one preferred embodiment as shown in the drawings is a vertical type connector, in which the daughter board 4 is vertically held on the connector 3, the present invention may be modified to be an inclined type for a tilting positioning of the board 4 on the connector.

The latch 1 of the present invention may also be made of plastic material if its elasticity, strength and workability are properly equivalent to the metal material.

I claim:

1. An electrical connector comprising: a longitudinal socket longitudinally formed in the connector for inserting a daughter printed circuit board therein, a plurality of slots transversely formed in the connector each said slot generally perpendicular to the longitudinal socket for embedding a spring contact element having a supporting leg member protruding downwardly from the connector to be inserted into a leg hole formed in a mother board, and two stop members formed on two opposite end portions of the connector each stop member generally parallel to the longitudinal socket, and formed with an alignment protrusion on a top portion of each stop member;

a pair of latch holding bases respectively formed on two opposite end portions of said connector; and at least two metal latches disposed on two opposite end portions of said connector each said latch embedded on each said latch holding base of said connector, each said latch having a pair of snapping leg members engageably locked in each said base on said connector for clamping the daughter board on said connector secured with the mother board for an electrical connection between said daughter and mother boards.

2. An electrical connector according to claim 1, wherein each said latch holding base formed on each end portion of the connector includes: a horizontal surface portion formed on an upper portion of the base, a pair of blade holes slotted in the horizontal surface portion, an upper recess recessed in an upper portion of a vertical surface portion which is formed on an outer side portion of the connector perpendicular to the horizontal surface portion, a lower recess having a width larger than a width of the upper recess and recessed in a lower portion of the vertical surface portion communicating with and enlarged downwardly from the upper recess, and a bottom surface formed on a bottom of the base coplanar to a bottom surface of the connector, and two enlarge shoulder portions diverging downwardly from said upper recess and defined between the upper recess and the lower recess.

3. An electrical connector according to claim 1, wherein each said metal latch includes: a base plate generally formed with a horizontal plate engageable with the latch holding base formed on the connector, a pair of snapping leg members protruding downwardly from an outer edge portion of the base plate to continuously engaged with the upper recess and the lower recess of the latch holding base, a vertical latch member protruding upwardly from the base plate to be perpendicular to the longitudinal socket of the connector, an arcuate spring portion concaved outwardly in a middle portion of the vertical latch member normally restoring the vertical latch member vertically, a depression plate portion formed on an uppermost portion of the vertical latch member protruding outwardly upwardly from the vertical latch member, and a latching wedge portion formed on an upper portion of the vertical latch member below the depression plate portion tapered rearwardly and inwardly for slidably guiding a daughter board to be resiliently clamped by the two latches and stopped by the two stop members respectively formed on two opposite end portions of the connector.

4. An electrical connector according to claim 3, wherein said latching wedge portion has an acute angle defined between a front wedge surface and a rear vertical surface of each wedge portion, said rear vertical surface generally perpendicular to an upper vertical surface portion formed on an upper portion of the vertical latch member for engageably retaining a daughter board clamped between the two metal latches.

5. An electrical connector according to claim 3, wherein said base plate includes two embedding blade members respectively protruding downwardly from a front and a rear edge portion of the base plate to be engageable with the two blade holes formed in the latch holding base.

6. An electrical connector according to claim 3, wherein said two snapping leg members define a bifurcated aperture between the two leg members for a collapsible depression of the two leg members for passing an upper recess and for resiliently expandibly engaging a pair of hook portions formed on two lower portions of the two leg members to be lockably engageably with two enlarged shoulder portions defined between the upper recess and the lower recess formed on a lower portion of said upper recess recessed in a vertical surface portion of an outer side portion of said connector.

7. An electrical connector according to claim 6, wherein each said hook portion of each of the snapping leg member has a tip portion formed on a lowermost portion of the leg member to projectively protrude beyond a bottom surface of the base and the connector.

* * * * *